US008933864B1

(12) United States Patent
DiSanto et al.

(10) Patent No.: US 8,933,864 B1
(45) Date of Patent: Jan. 13, 2015

(54) PASSIVE MATRIX PHOSPHOR BASED COLD CATHODE DISPLAY

(75) Inventors: Frank J. DiSanto, Cat Spring, TX (US); Denis Krusos, Melville, NY (US)

(73) Assignee: CopyTele, Inc., Melville, NY (US)

( * ) Notice: Subject to any disclaimer, the term of this patent is extended or adjusted under 35 U.S.C. 154(b) by 1347 days.

(21) Appl. No.: 12/288,402

(22) Filed: Oct. 20, 2008

Related U.S. Application Data

(60) Provisional application No. 60/999,783, filed on Oct. 19, 2007.

(51) Int. Cl.
*G09G 3/28* (2013.01)

(52) U.S. Cl.
USPC ..... 345/60; 345/75.1; 345/75.2; 313/495; 313/309; 313/336; 313/351

(58) Field of Classification Search
None
See application file for complete search history.

(56) References Cited

U.S. PATENT DOCUMENTS 3,904,923 A * 9/1975 Schwartz ..... 348/797
4,041,342 A * 8/1977 Catanese et al. ..... 313/105 R
4,130,777 A * 12/1978 De Jule ..... 345/74.1
4,164,681 A * 8/1979 Catanese ..... 313/400
4,461,978 A * 7/1984 Mikoshiba et al. ..... 315/169.4
4,575,765 A * 3/1986 Hirt ..... 348/800
6,011,567 A * 1/2000 Nakamura et al. ..... 347/115
6,023,126 A * 2/2000 Karpov ..... 313/310
6,417,606 B1 * 7/2002 Nakamoto et al. ..... 313/336
2002/0079802 A1 * 6/2002 Inoue et al. ..... 313/309
2006/0290262 A1 12/2006 Krusos et al.
2007/0030216 A1 2/2007 DiSanto et al.

* cited by examiner

*Primary Examiner* — Jesus Hernandez
(74) *Attorney, Agent, or Firm* — Law Office of Carl Giordano, PC

(57) ABSTRACT

A flat panel display including a plurality of electrically addressable pixels; using a passive matrix on a first substrate, a passivating layer on at least partially around the pixels; a conductive frame on the passivating layer, and a plurality of cold cathode emitters on select portions of the conductive frame within the display, wherein exciting the conductive frame and addressing one of the pixels using the associated passive matrix causes electrons to strike at least one of the pixels and result in the emission of light from those pixels. Using a metal layer (ML) on a second substrate the extent of electrons emitted is enhanced through the incorporation of a noble gas or mixture thereof, causing a multiplication of the electrons emitted by the cold cathode when the gas is ionized.

16 Claims, 8 Drawing Sheets

PASSIVE MATRIX PHOSPHOR BASED COLD CATHODE DISPLAY

CLAIM OF PRIORITY

This application claims the benefit of the earlier filing date, under 35 USC 119(e), to provisional patent application Ser. No. 60/999,783, entitled "Passive Matrix Phosphor Based Cold Cathode Display," filed on Oct. 19, 2007, the entire contents of each of which are hereby incorporated by reference herein (Copy-88P). This application also claims the priority, as a continuation-in-part of co-pending US application, entitled "Flat Panel Display Incorporating a Control Frame," filed on Jul. 11, 2006 and afforded Ser. No. 11/484,889 (Copy-74-CIP-3), which claims the benefit of the earlier filing date, under 35 USC 119(e), to provisional patent application Ser. Nos. 60/698,047 filed on Jul. 11, 2005 and 60/715,191, filed on Sep. 8, 2005, and further claims priority, as a continuation-in-part, of co-pending U.S. patent application Ser. No. 10/974,311, entitled "Hybrid Active-Matrix Thin-Film Transistor Display," filed on Oct. 27, 2004, which is a continuation-in-part of U.S. patent application Ser. No. 10/782,580 entitled "Hybrid Active-Matrix Thin-Film Transistor Display," filed on Feb. 19, 2004, which is a continuation-in-part of U.S. patent application Ser. No. 10/763,030, entitled "Hybrid Active Matrix Thin-Film Transistor Display," filed on Jan. 22, 2004, which is a continuation-in-part of U.S. patent application Ser. No. 10/102,472, entitled "The Pixel Structure For An Edge Emitter Field Emission Displays" filed on Mar. 20, 2003.

FIELD OF THE INVENTION

This application is generally related to the field of displays and more particularly to a flat-panel display (FPDs) using passive matrix cold cathode emitters with noble gas enhancement.

BACKGROUND OF THE INVENTION

Flat panel display (FPD) technology is one of the fastest growing display technologies in the world, with a potential to surpass and replace Cathode Ray Tubes (CRTs) in the foreseeable future. As a result of this growth, a large variety of FPDs exist, which range from very small virtual reality eye tools to large hang-on-the-wall television displays.

It is desirable to provide a display device that may be operated in a cold cathode field emission configuration using for example, nanotubes, edge emitters, and so on. Such a device would be particularly useful as a low voltage FPD, incorporating a cold cathode based electron emission system, a pixel control system, and phosphor based pixels, with or without memory.

SUMMARY OF THE INVENTION

In one exemplary embodiment, a flat panel display comprising a first substrate, a passive matrix on the substrate having M rows and N columns with each intersection of a row and column defining a pixel location, a second substrate joined to the first substrate about the periphery to form a display housing having an internal hollow, an ionizable gas contained in the hollow, a plurality of cold cathode emitters selectively located on the display and positioned when energized to emit electrons to activate a selected pixel, means coupled to the passive matrix and the display to select a pixel and means to ionize the gas and selected cold cathodes causing the pixel selection to induce the selected pixel to emit light.

In one exemplary embodiment, there is provided a thin, phosphor-based passive matrix flat panel vacuum display. Adjacent to each pixel in the matrix is a control/conductive frame which may contain cold cathode emitters. Each pixel has color or monochrome phosphors which are activated by electrons created by a voltage potential between the frame, the pixel and a metal layer (ML). The electrons strike the phosphor and cause the phosphor to emit light. Each pixel is addressed through a passive matrix structure.

BRIEF DESCRIPTION OF THE DRAWINGS

It is to be understood that the accompanying drawings are solely for purposes of illustrating the concepts of the invention and are not drawn to scale. The embodiments shown in the accompanying drawings, and described in the accompanying detailed description, are to be used as illustrative embodiments and should not be construed as the only manner of practicing the invention. Also, the same reference numerals have been used to identify similar elements.

DETAILED DESCRIPTION OF THE INVENTION

It is to be understood that the figures and descriptions of the present invention have been simplified to illustrate elements that are relevant for a clear understanding of the present invention, while eliminating, for the purpose of clarity, many other elements found in typical FPD systems and methods of making and using the same. Those of ordinary skill in the art would recognize that other elements and/or steps may be desirable and/or required in implementing the present invention. However, because such elements and steps are well known in the art, and because they do not facilitate a better understanding of the present invention, a discussion of such elements and steps is not provided herein.

Before embarking on a more detailed discussion of the invention claimed, it is noted that passive matrix displays and active matrix displays are types of FPDs that are used extensively as various display devices, such as in laptop and notebook computers, for example. A passive matrix display utilizes a matrix or array of solid-state elements, where each element or pixel is selected by applying a potential voltage to corresponding row and column lines that form the matrix. An active matrix display further includes at least one transistor and capacitor that is also selected by applying a potential to corresponding row and column lines.

According to an aspect of the present invention a passive matrix control system includes a control/conductive frame adjacent to each pixel that is used to supply electrons for activation of a phosphor element of a corresponding pixel.

The control/conductive frame adjacent to each pixel is disposed in an inactive area between the pixels. The control/conductive frame accommodates cold cathode electron emission structures, and is suitable for operation at low voltages.

The electron emitting structures may take the form of carbon nanotubes, edge emitters, tips or any other cold emitter.

The control frame can be formed using standard lithography, deposition and etching techniques.

In one exemplary configuration, conductors parallel or perpendicular to columns and rows are electrically activated when a voltage is applied thereto. In another exemplary configuration, conductors parallel or perpendicular to columns and rows are electrically isolated and energized or activated in a known sequence for a known time period.

The control frame, which includes a cold cathode select area upon which resides a low work function emitter layer, enables display operation at low voltages, such as a maximum voltage of less than around 40 volts. Such a configuration is well suited for being operated as a flat display device. Further, incorporating a control/conductive/emitter layer frame configuration enables a much simpler production method than that associated with prior art configurations, that utilize "suspended" or elevated grid structures.

Figure 1:
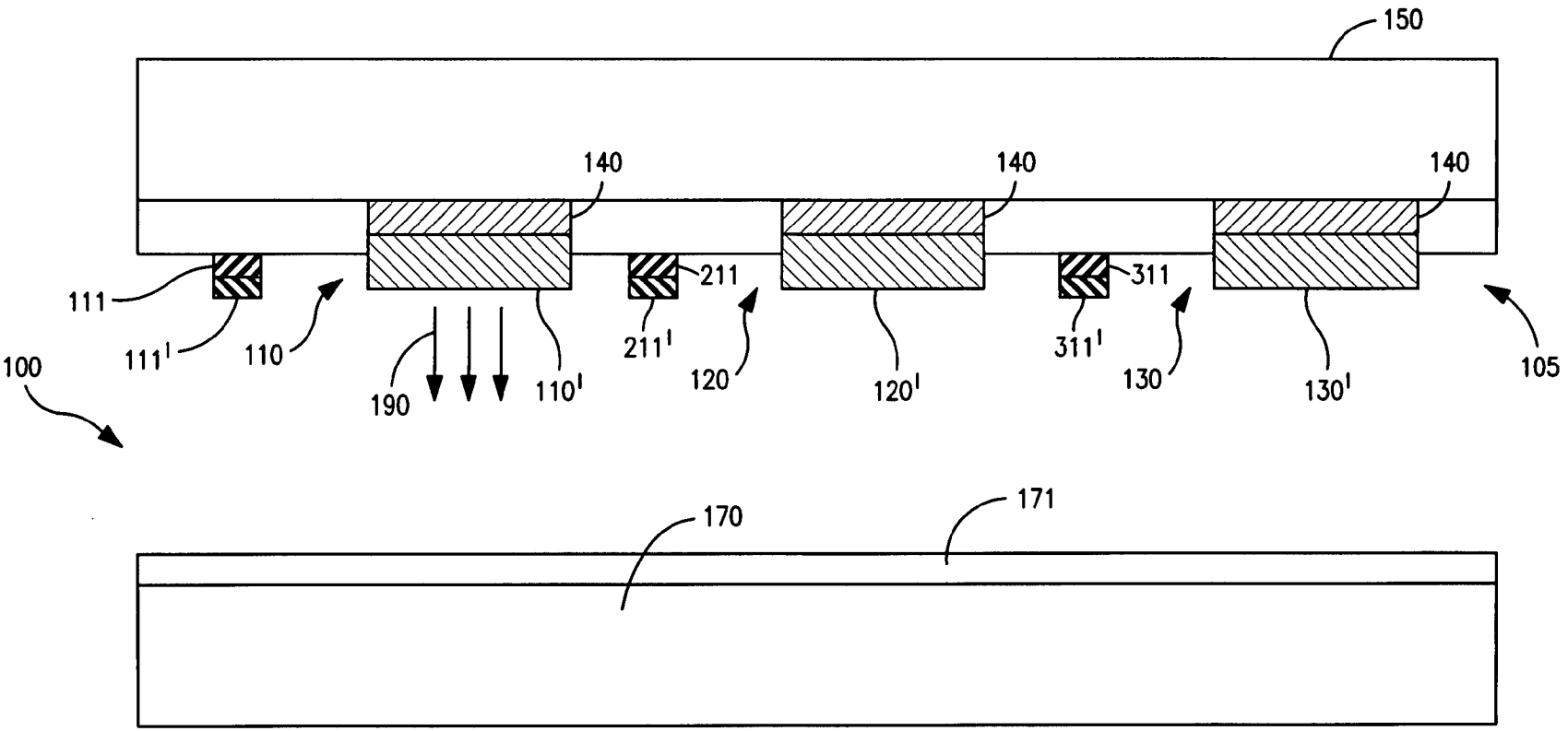
FIG. 1 illustrates an exemplary display device according to an embodiment of the present invention.

FIG. 1 illustrates a schematic cross-sectional view of a passive matrix based FPD 100 according to an exemplary or non-limiting embodiment of the present invention. The matrix is an X-Y matrix having X columns and Y rows (see FIG. 2). In the exemplary embodiment shown in FIG. 1, display 100 is composed of an assembly 105 that includes pixels (110, 120, and 130) and cold cathode conductive frames (111, 211, and 311) on substrate (150). In one aspect of the invention, on each of cold cathode conductive frames 111, 211, 311, are corresponding low work function emitter layers 111', 211' and 311'. There is also shown a second substrate (170), having a metal layer (ML) 171 deposited or formed on substrate 170. The ML layer 171 may be a transparent conductive layer, such as a layer of ITO, for example.

Figure 2:
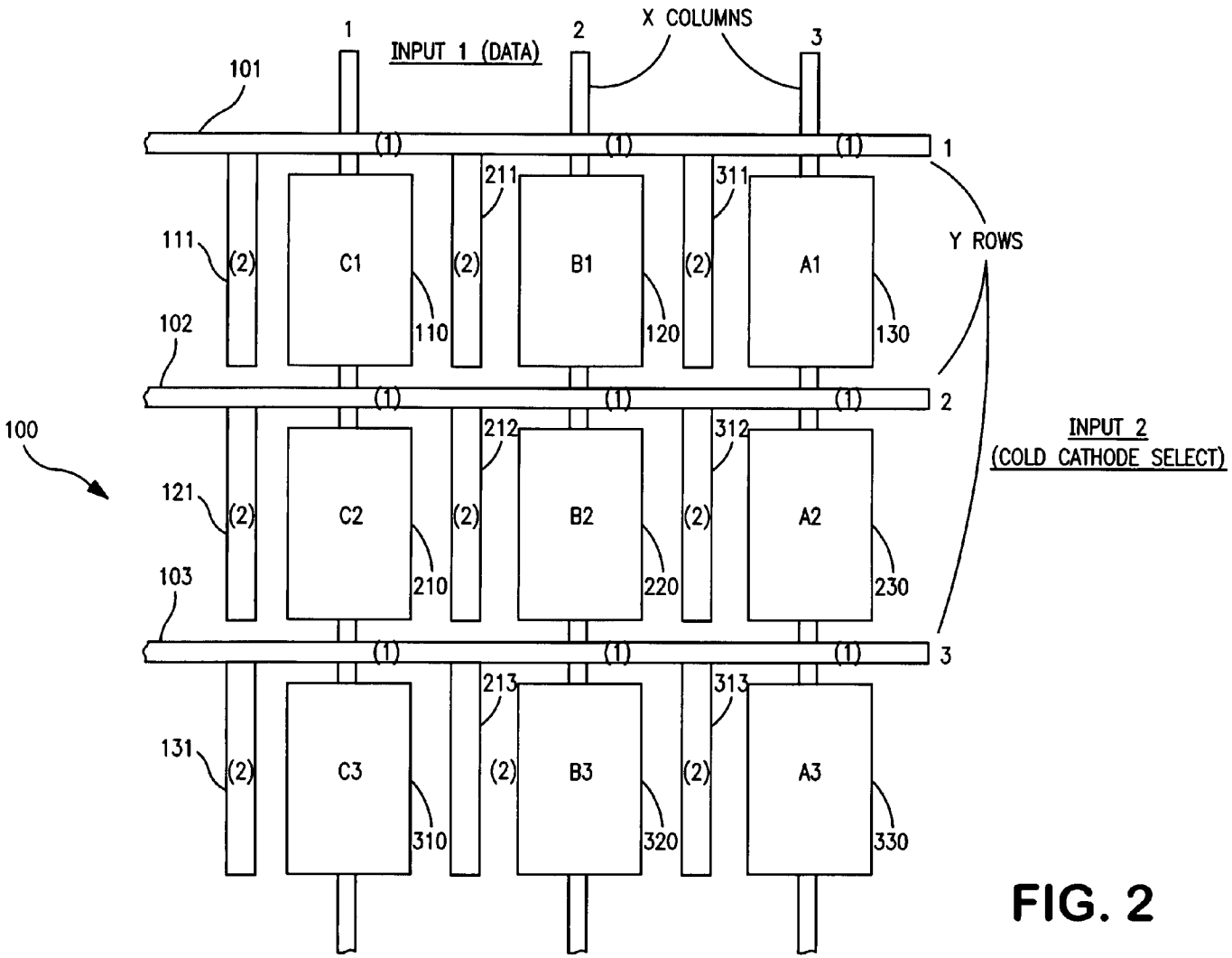
FIG. 2 illustrates an exemplary X-Y passive matrix configuration according to an embodiment of the present invention.

FIG. 2 shows an exemplary embodiment consisting of a passive X-Y matrix with an Input 1 (Data) and an Input 2 (Cold Cathode Select). Input 1 applies Image Data to Input 2 Row 1, 2, 3, etc., and Input 2, synchronously with the applied Data, selects cold cathode 1 2, 3, etc., causing the desired illumination of the pixels (e.g. reference numeral 110 of FIG. 1) in each of the selected rows, thereby forming the desired image. Accordingly, a timely and sequentially applied voltage to each of the cold cathode select lines (or conductive lines) 101, 102, 103 provides for the timely emission of electrons during the sequential activation of each pixel in a selected column. In addition, it would be understood that no electrical connection exists between the column lines associated with Input Data 1 and row/cold cathode select lines associated with Input 2.

In this illustrated example, cold cathode select lines 101, 102 and 103 are comparable to row select lines, which are known by those skilled in the art of matrix displays. However, as would be understood by those skilled in the art, after a review of the description of the invention herein, the cold cathode select lines and rows lines 101, 102, 103 may be the same or different lines. In the case, where the cold cathode select lines and the row lines are different, it would be recognized that the row lines are not shown in FIG. 2. Thus, in this case, the row lines would cause the activation of a pixel line, while the cold cathode select line would allow for a controlled emission of electrons based on a voltage applied to the cold cathode select line. The voltage applied to the row line may be different than that applied to the cold cathode select line.

In this illustrated example (FIG. 2), when Input 1 is "High" on any one of the illustrated columns, all pixels in the column are "High" and the remaining pixels in other columns are "Low," i.e., non-activated. For example, a voltage applied to as Input 1, Col. 1 places each of the pixels referred to as C1, C2 and C3 in a "High" or active state and each of the pixels referred to as A1, A2, A3, and B1, B2, B3 remain in "Low," or non-active state. When a voltage is applied to Input 2 Row 2 (102) then each of pixels C1 and C2 would emit light as electrons may be drawn from cathode select line (row line) 102 to pixels C1 and C2. However, the generation of electrons from both pixels C1 and C2 is an undesired result.

As further illustrated in FIG. 2, a cold cathode emitter layer 111', 211', 311' are selectively placed on corresponding frame conductors 111, 211, 311, etc., adjacent to each pixel. In the embodiment of the inventions shown, no cold cathode emitter layer is placed on the horizontal portions of conductors 101, 102, 103, etc. But are placed on the vertical portions of conductors 101, 102, 103, etc. Thus, in this exemplary embodiment of the invention, when cold cathode select line 102 is activated, only pixel C2 is illuminated as electrons may be drawn only from corresponding cold cathode emitter 121'. Thus, the problem of multiple emitters being illuminated with the selection of a row or cold cathode select line may be eliminated. While the cold cathode emitter layers 111', 211', 311', are shown placed on the corresponding cold cathode frame conductors, the cold cathode emitter layers 111', 211', 311', can be placed anywhere on the display as once a pixel is selected the cold cathode emitters corresponding to the selected pixel will cause electrons to flow to that pixel. Although not shown it would be recognized that the cold cathode conductive layer (and row lines) not including the emitter layer may include a passivation layer that prevents the emission of electrons from the areas not associated with the emitter layer.

FIG. 2 also shows that an additional benefit of this configuration permits a smaller space between pixels A1 and A2, B1 and B2 etc. as conductors 102, 103, etc. can be made narrower than the cold cathode emitters layers 111', 211',311', etc. The reduced spacing is advantageous as it results in a higher resolution display and a higher fill factor (i.e., the ratio of the pixel size to the pixel configuration is larger or higher than in a conventional display. Accordingly, a narrow row select (not shown) may be electrically isolated from a narrow cold cathode line in a horizontal (or X direction), but the width of the cold cathode select line may be increased when the cold cathode select line is positioned in the vertical (or Y-direction).

In one aspect of the invention, the display may be produced using Soda Lime Glass which results in a significantly lower cost. Soda-lime glass can be created by melting a mixture of silicon dioxide, sodium carbonate, and either calcium carbonate or calcium oxide. Soda-lime glass is advantageous as there is no leakage the glass contaminates into the silicon required for active components, such as is present in active matrix displays.

In the exemplary embodiment shown in FIG. 1, deposited on substrate 150 is a conductive pixel pad 140 of associated with each pixel is phosphor layer 110, 120, 130. Each phosphor layer is selected from materials that emit photons 190 of a specific color, wavelength, or range of wavelengths. In a conventional RGB display, the phosphor layers are selected from materials that produce red light, green light or blue light when struck by electrons. In the illustrated embodiment, when a voltage ($V_{anode}$) is applied to the conductive pad 140, electrons are drawn from the cold cathode layer 111 to conductive pad 140. The emitted electrons when striking the corresponding phosphor layer causes the phosphor layer to emit light (i.e. photons in the direction of substrate 170 for viewing. If the pixel metal of conductive pad 140 is of a transparent (or translucent) material (such as ITO) rather than opaque, light emissions 190 would be transmitted in both the directions towards substrates 150 and 170, rather than being reflected via the pixel metal of conductive pad 140 to substrate 170 only, for example.

Emissive displays using phosphor 110 to emit light in order to display an image include a source of electrons, pixels consisting of phosphor on a conductive surface, and a conductive layer (ML) 171 capable of extracting electrons from the display surfaces.

In a cold cathode display of the type described herein, the source of electrons may be nanotubes, edge emitters, tips, and the like. The phosphor element is placed on the pixels and light is emitted from the phosphor when the electrons emitted by the cold cathode emitter layer 111', for example, strike the phosphor. The amplitude of the illumination is a function (for example, a linear function) of the number of electrons arriving at the phosphor for a given voltage. Any means to maximize the electron flow from the cold cathode emitter layer 111' to the phosphor optimizes the illumination and performance of the display. By varying the voltage applied to ML (FIG. 1—reference numeral 171) and optimizing the effect of the field generated by the ML 171 voltage, depending on the physical configuration of the display, will result in an increase of the electron flow from the cold cathode to the phosphor for given pixel voltage, resulting in increased brightness. The voltage on ML 171 for optimum performance is a function of the geometry of the components in the display and is determined independently for the physical structure of the particular display.

It is understood that the display of FIG. 1 requires substrate 150 to be bonded or otherwise attached to substrate 170. Thus, the substrates are bonded or sealed about the peripheries creating an internal hollow or space between the substrates. In certain prior art devices this space contains a vacuum to allow a lesser voltage difference to draw electrons from the emitter layer.

In this display according to one aspect, the space or hollow created by sealing substrates 150 and 170 together contains a noble gas, such as argon and/or mixtures of other noble gases, at low pressure. A voltage is applied to ML 171 to create a glow discharge (Townsend Discharge) results in multiplication of the current produced by the cold cathode electron emitting source (e.g., nanotubes, edge emitters, etc.). Such multiplication may be about ten or more orders of magnitude while the applied voltage is virtually constant. Utilizing the Townsend Discharge and using the voltage on ML 171 to accentuate the multiplication of the electron current emitted by the cold cathode emitter layer increases the brightness of the display without requiring an increase in the cold cathode voltage. Since the photons (light level) emitted by the phosphor is essentially a linear function of the power then the brightness, at a constant voltage on the pixel, is a linear function of the current. Thus, as the current increases by ten or more orders of magnitude by the Townsend Discharge, then the brightness will increase at the same rate. The 'sufficiently strong electron field" required for the Townsend Discharge to occur is caused by the voltage applied to ML. The Townsend Discharge is a gas ionization process where a small amount of free electrons accelerated by a sufficiently strong electric field give rise to electrical conduction through a gas by avalanche multiplication. When the number of free charges drops or the field weakens, the process stops. Townsend Discharge is named after John Sealy Townsend.

Figure 3:
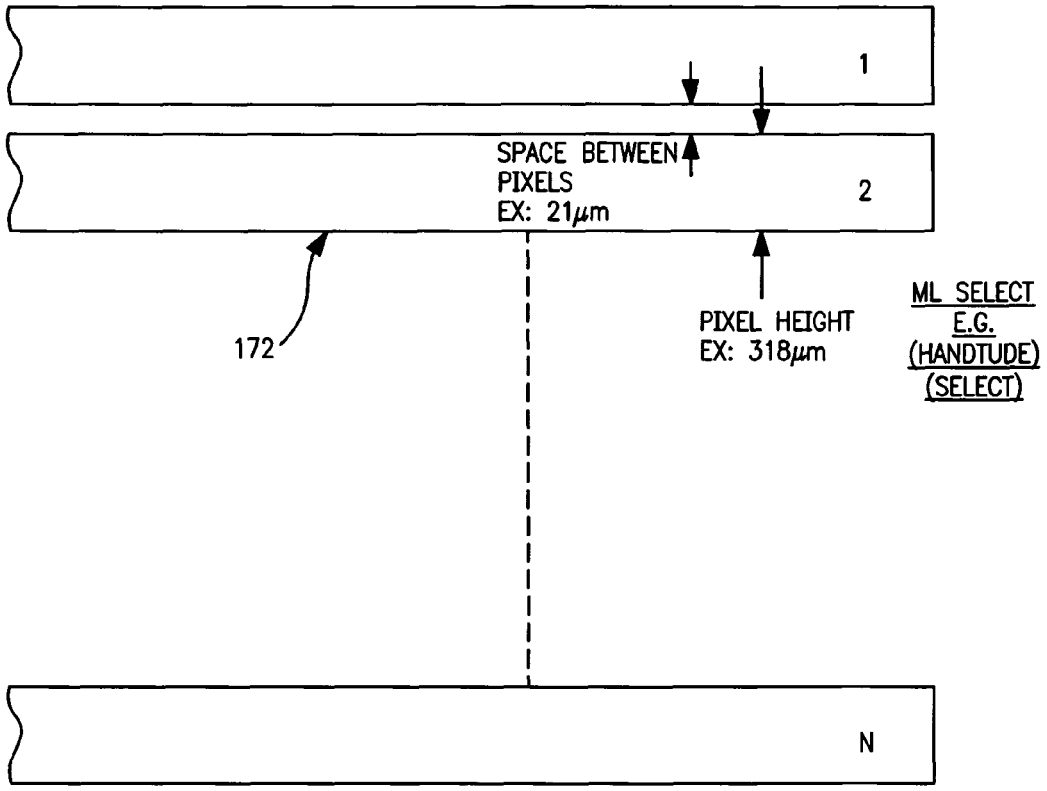
FIG. 3 illustrates an exemplary embodiment containing ML stripes whose width is approximately equal to the dimensions of the pixels according to an embodiment of the present invention.

FIG. 3 shows another exemplary configuration describing various principles and features associated with an embodiment of the present invention. Referring now to FIG. 3, there is shown a plan view of ML stripes 172 on substrate 170 (FIG. 1) whose width is approximately equal to the dimension of the pixels, as shown in FIG. 2. The ITO stripes (ML strips 172) are energized by a driver in synchronism with the cold cathode select driver. Drivers for performing such selection and energizing functions are well known and will not be further discussed for brevity. However, in an exemplary embodiment, driver circuitry such as described in co-pending, commonly assigned U.S. patent application Ser. No. 11/484,889, published as patent application Publication No. 2006-0290262, entitled "Flat Panel Display Incorporating a Control Frame" published Dec. 28, 2006 (the subject mailer thereof incorporated by reference in its entirety), or co-pending, commonly assigned U.S. patent application Ser. No. 11/499,841, published as patent application Publication No. 20070030216, entitled "Edge emission electron source and TFT pixel selection" published Feb. 8, 2007 (the subject mailer thereof incorporated by reference in its entirety), or other known driver for lines selection/activation may be useful in implementing such driver functionality. When cold cathode A1, A2, A3, etc. (FIG. 4) are energized ML stripe 172 is activated which results in the Townsend Discharge of the ionizable gas in the vicinity of the selected emitter row. This process continues in the same manner for each row of cold cathodes selected. The advantage of using ML stripes is the reduction of the power consumed by the ML during a specific time period. The decrease in power is approximately equal to the power consumed by an ML structure consisting of a single ITO conductor divided by the number of rows of pixels. For example, if the display is a 960×240 structure then the power required by this design of ML stripes 172 is equal to the power required by a single sheet ML construction divided by 240.

While the illustrated embodiment depicts metal lines or stripes parallel to the grid to enable ionization of the gas, it is understood that various other configurations and arrangements are also contemplated such that ionization of the gas occurs when the pixel is selected or activated, including ionization of the gas without use of ML stripes. While stripes are shown, any other configuration can be used such as a sheet of ML or ITO.

As discussed above, the cold cathode emitter layer 111', 121', 131', etc., may take the form of any electron emitter material having a suitably low work function. Suitable candidates for selection as electron emitters include layers having nano- and/or micro-structures, for example.

The nanostructures may take the form of carbon nanotubes, for example, that may be selected as single-wall carbon nanotubes (SWNTs) and/or multiple wall carbon nanotubes (MWNTs). The nanostructures may be applied to substrate 150 or cold cathode select line 111 using any conventional methodology, such as spraying, growth, electrophoresis or printing, for example.

By way of further non-limiting example only, where substrate 150 takes the form of a glass surface then the substrate may be metalized with Mo for form cold cathode conductive element 102 (121). Electrophoresis may then be used to apply nanotubes to the metalized surface. For example, about 5 mg of commercially available carbon nanotubes may be suspended in a mixture of about 15 mL of Toluene and about 0.1 mL of a surfactant, such as polyisobutene succinamide (OLOA 1200). The suspension may be shaken in a container with beads for around 3-4 hours. Thereafter, the metalized surface may be immersed in the shaken suspension, while applying a DC voltage to the metalized surface that is positive relative to a suspension electrode (where the nanotubes have a relatively negative charge).

Figure 5:
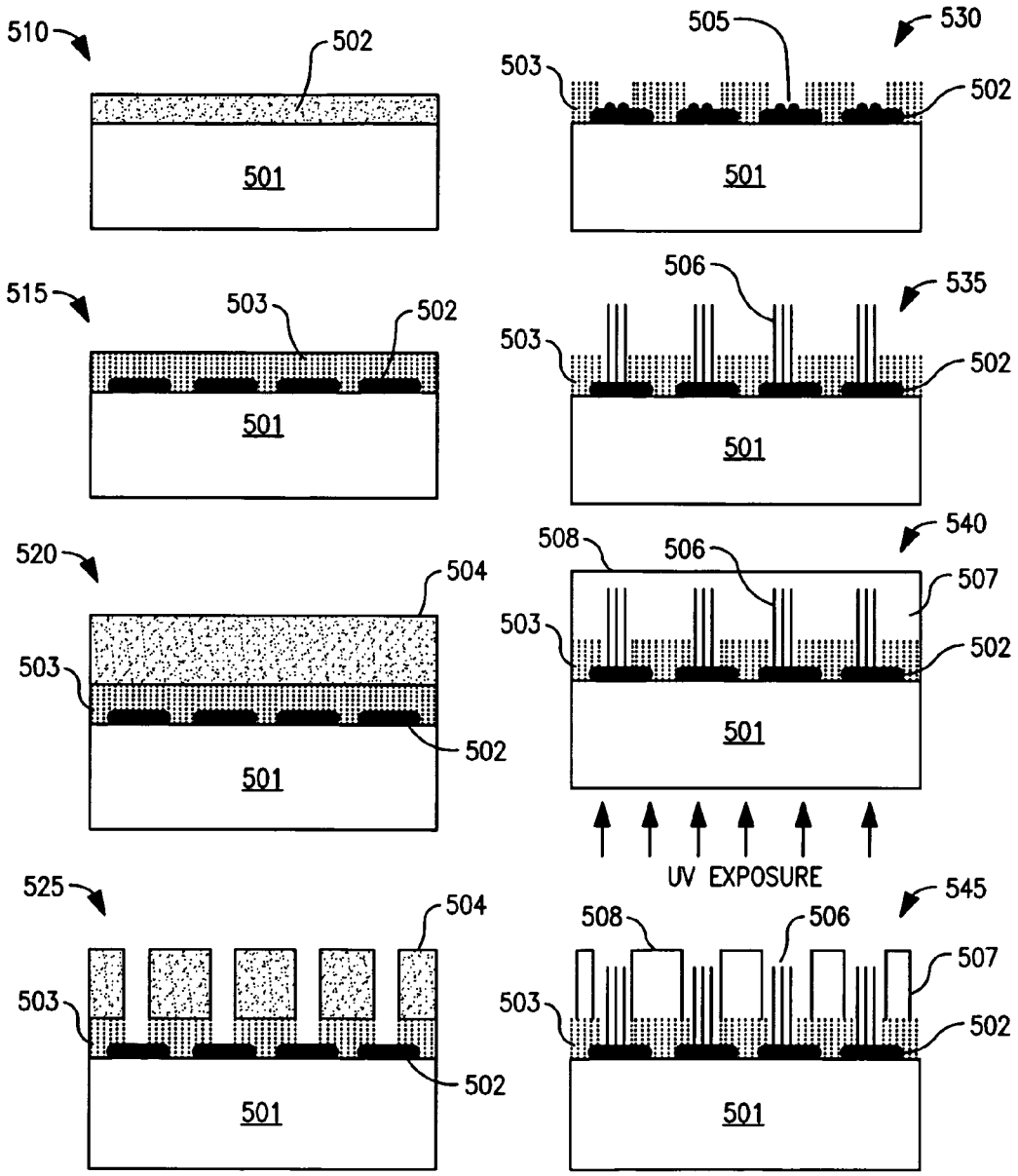
FIGS. 5-7 illustrate processes for forming cathodes for implementing display devices according to embodiments of the present invention.

Alternatively, the nanotubes may be self-assembled. Referring now also to FIG. 5, there is shown a series of processing steps for creating nanotubes on the cold cathode conductive row. Referring first to step 510, there is shown a substrate 501 having a coating 502. Substrate 501 may take the form of any conventional substrate suitable for supporting the cathode shown. In certain embodiments, it may be desirable that the substrate and coating appear transparent to a user, where an image is to be viewed through substrate 501 and coating 502. Substrate 501 may take the form of a glass substrate. Coating 502 may take the form of chromium. Coating 502 may be about 100 nm thick. A resist coating may be spun onto coating 502. The resist may be patterned, such as by photolithographic processing, to provide alternating rows of photoresist and exposed chromium that will correspond to rows and columns as has been described with regard to FIG. 2. The chromium may then be etched to remove the exposed portions.

Referring now also to step 515, a layer 503 of SiO (silicon oxide), such as $Si0_2$, may be deposited onto the patterned coating 502. Layer 503 may be at least about 0.1 microns thicker than coating 502, to provide for insulation between what will become the cathode conductors and gate electrodes. Referring now to step 520, a positive resist layer 504, such as photo-resist, may be spun-coated onto layer 503. Layer 504 may be about 1 micron thick, for example. Layer 504 may be patterned, again using photo-lithographic techniques, for example, to provide openings roughly aligned with the remaining portions of layer 502. The patterned openings may be slightly smaller than the remaining portions of layer 502, by way of non-limiting example.

Referring now also to Step 525, patterned or exposed portions or regions of layer 503 may be removed, such as by buffered HF selective etching for example, to reveal at least portions of the remaining layer 502.

Referring now to Step 530, a catalytic layer 505 may be deposited onto the exposed portions of layer 502. Catalytic layer 505 may include iron, cobalt or nickel, by way of non-limiting example only. Layer 505 may be substantially uniform or may be patterned for example. By way of further non-limiting example only, layer 505 may be deposited using amplitude and duration controlled pulse-current electrochemical deposition to form nanoparticles on layer 502. Formed nanoparticles may typically be less than about 1.00 nm in size and may have a density between about $10^8$ and $108/cm^2$.

Referring now also to Step 535, nanostructures 506 may be formed on catalytic layer 505. Nanostructures 506 may take the form of self aligned arrays of carbon nanotubes. Nanotubes may be formed on catalytic layer 505 using any suitable methodology, such as that described in U.S. patent Publication No. 20040058153, the entire disclosure of which is hereby incorporated by reference herein.

Referring now also to Step 540, a resist coating layer 507, such as a 10 pm thick layer of SU-8 photo-resist, may be spun over nanostructures 506 and layer 503—to provide a standoff distance for the gate electrodes. Resist layer 507 may then be exposed, such as to UV through substrate 501. A post exposure baking step may also be affected. A metallization layer 508 may be deposited upon layer 507. Metallization layer 508 may be composed of chromium, for example. Layer 508 may form gate electrodes 130 (FIG. 8) and be about 50 nm thick, for example.

Figure 6:
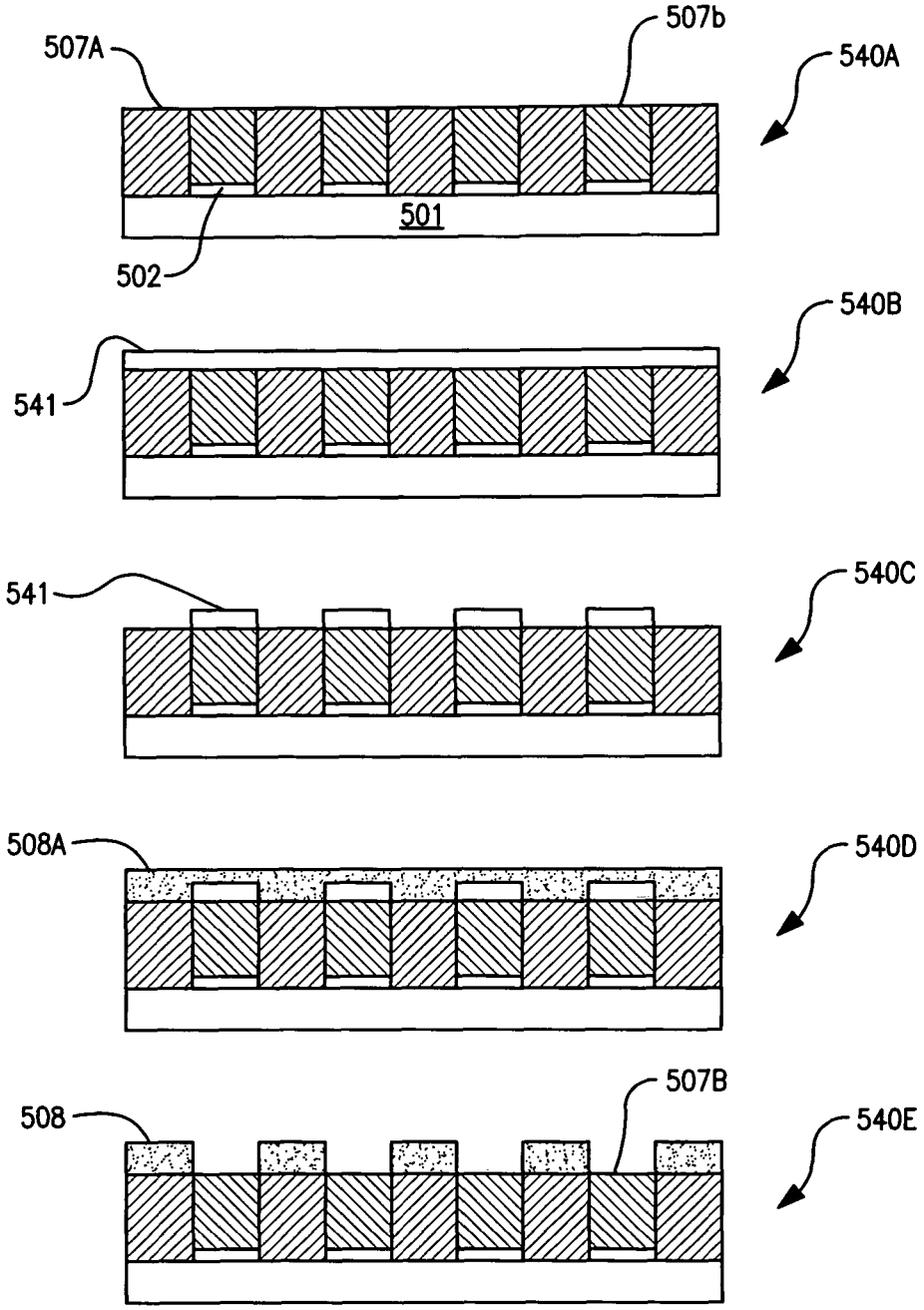

Referring now also to FIG. 6, there is shown a process for gate formation suitable for use with process 500. Steps 540A-540E may provide for step 540. In step 540A, there is shown substrate 501, layer 502 patterned in conductive islands and resist layer 507. Emitting structures, such as nanotubes, may already be formed on the patterned islands of coating 502. Resist layer 507 may take the form of SU-8 photoresist. Layer 507 may be exposed through substrate 501 to yield cross-linked SU8 regions 507A and non-cross-linked regions 507B. As will be understood by those possessing an ordinary skill in the pertinent arts, the positioning of regions 507A and 507B is dependent upon patterned coating 502, as layer 507 is cured through the substrate such that patterned coating 502 serves as a mask.

Referring now to step 540B, a layer 541 of photo-resist may be deposited onto the construction of step 540A. The photo-resist of layer 541 may have improved lift-off operability as compared to the resist of layer 507. Layer 541 may be composed of 1805 photo-resist, for example. The 1805 photoresist may be spun onto the construct of step 540*k* Referring now to step 540C, layer 541 may be back-exposed and developed, and thereby patterned. Again, as will be understood by those possessing an ordinary skill in the pertinent arts, via back-exposing the pattern of layer 541 is dependent upon the pattern of conductive islands of layer 502.

Referring now to step 540D, a metallization layer 508A may be deposited over the construct of step 540C. Layer 508A may be composed of chromium, for example. Referring now also to step 540E, the construct of step 540D may then be subjected to a lift-off process, such as through the use of a developer like MF-319 or acetone—thereby providing metallization layer 508.

Referring again to FIG. 5, and now to step 545, layer 507 (507B in FIG. 6) may be developed to expose nanostructures 506. The composite structure may then be hard baked.

Processing consistent with that described with reference to FIGS. 5 and 6 provides a composite structure having chromium gate electrodes (layer 508) upon hard baked SU-8 photo-resist standoffs (layer 507) and nanostructures (layer 506) upon chromium layer (502) within wells between gate electrodes. The wells in the SU-8 layer (507) may be wider than the exposed chromium stripes thus providing insulation and serving to mitigate a risk of shorts and leaks as the edges of the chromium stripes are covered by SiOx (layer 503), where x is typically 2.

Processing consistent with that described with reference to FIGS. 5 and 6 provides a composite structure having chromium gate electrodes (layer baked SU-8 photo-resist standoffs (layer 507) and nanostructures (layer 506) upon chromium layer (502) within wells between gate electrodes. The wells in the SU-8 layer (507) may be wider than the exposed chromium stripes thus providing insulation and serving to mitigate a risk of shorts and leaks as the edges of the chromium stripes are covered by SiOx (layer 503).

Figure 7:
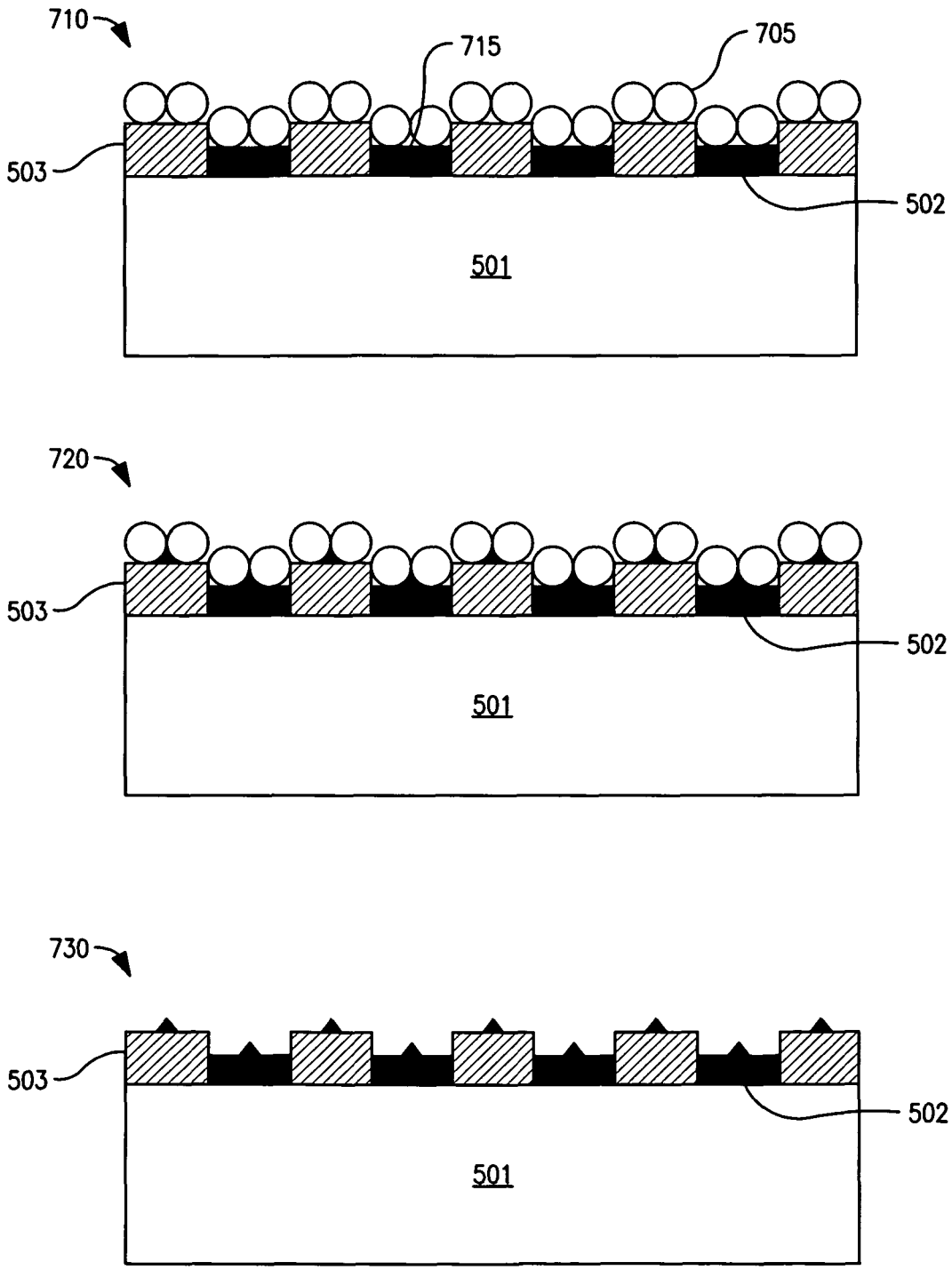

Alternatively, the emitting structures may take the form of tip emitters. Referring now also to FIG. 7, there is shown an alternative processing according to an embodiment of the present invention. To utilize the processing of FIG. 7, after step 525 (FIG. 4), processing may proceed as follows. Referring, now to step 710, a layer of nanoparticles 705 may be deposited upon layers 502, 503. Layer 705 may take the form of a monolayer of nanospheres. The spheres may be about 2 pm in diameter, for example. The spheres may be largely composed of polystyrene, for example. Layer 705 may be formed using any conventional technique. Layer 705 forms open spaces 715, in a hexagonal pattern, for example. The density of the open spaces may be controlled through the use of additional monolayers of spheres, for example. According to an aspect of the present invention, the density of spaces may be about $10^5/cm^2$ to about $10^9/cm^2$, or around about $106/cm^2$.

Figure 4:
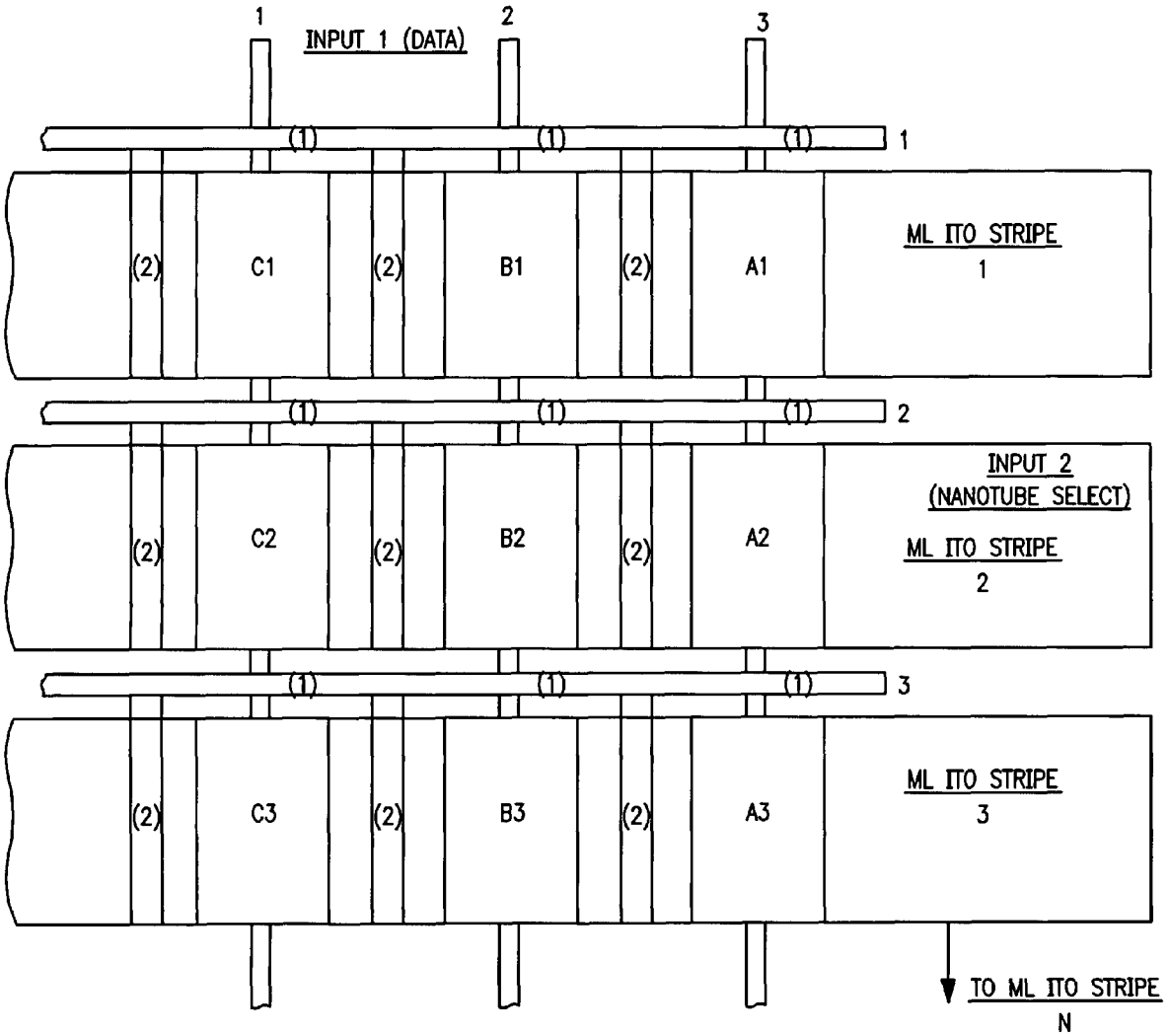
FIG. 4 illustrates an exemplary embodiment showing relative position of the ML stripes and the pixels according to an embodiment of the present invention.

Referring now to step 720, a catalyst, such as nickel, may be deposited or sputtered over the layer 705, such that it coats the spheres of layer 705 and spaces 715. Referring now also to step 730, layer 705 may then be dissolved or selectively removed. This may be accomplished using a solvent that does not attack either Cr or Ni, such as Toluene. Processing may then proceed as shown in FIG. 4, commencing with Step 535.

In one aspect of the invention, the cold cathode conductive layer/emitter layer (111/111') may have an applied voltage proportional to a column voltage to provide a variable brightness control. For example, a cold cathode conductive layer 111 voltage of about one half the corresponding anode voltage has been found to produce good brightness and uniformity conditions, however, other voltages may be employed to optimize other aspects and features of the display, such as contrast, gray scale, and color combinations, for example. The anode voltage of each pixel determines the brightness or color intensity of each pixel.

Figure 8:
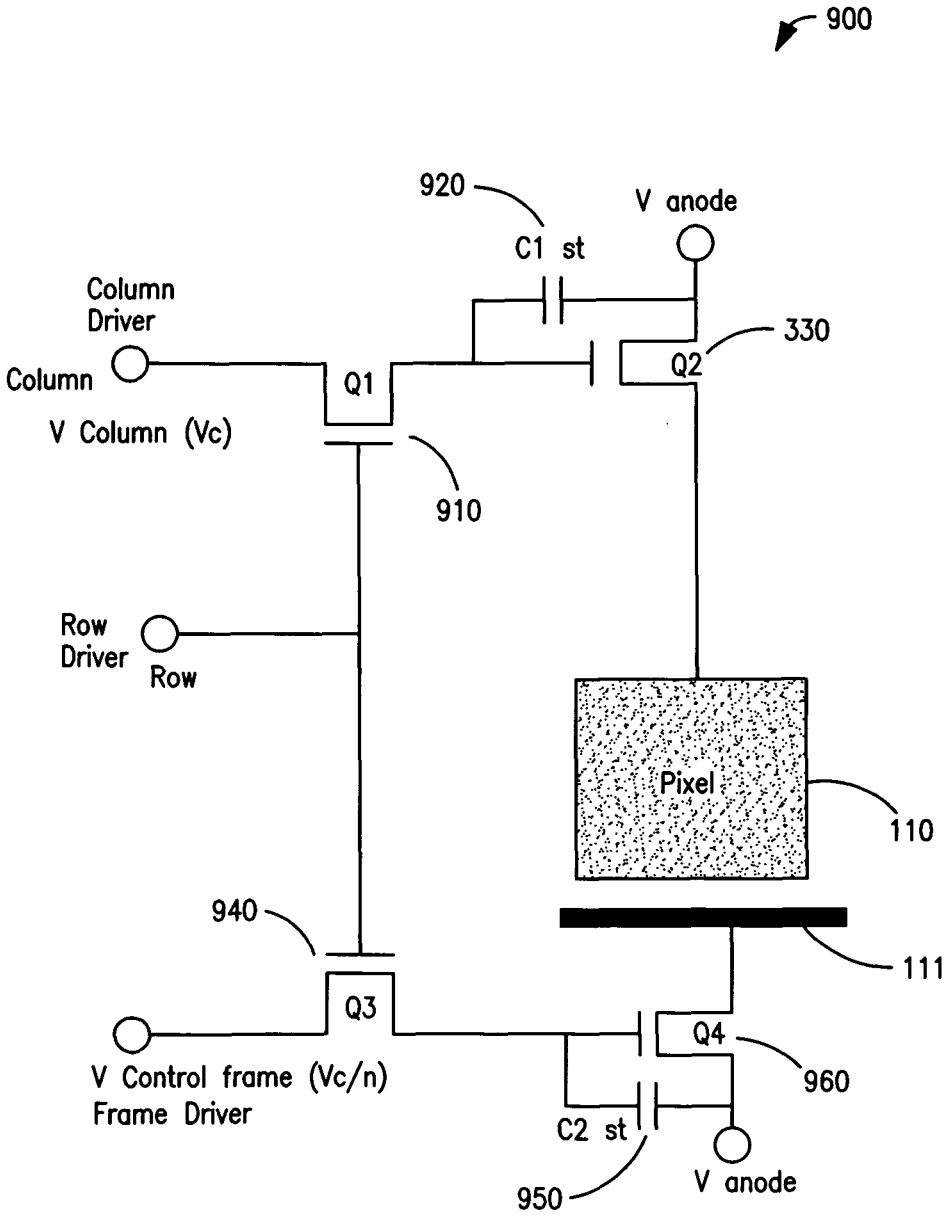
FIG. 8 illustrates a driving circuit according to an embodiment of the invention.

According to an aspect of the present invention, control of one or more of the pixels may be accomplished using the circuit 900 of FIG. 8. Circuit 900 includes first and second transistors 910, 930 and capacitor 920 electrically interconnected with a column of pixels, represented as pad 140 (FIG. 1). Third and fourth transistors 940, 960 and a second capacitor 950 may be used to generate a control frame or cold cathode select line voltage which is proportional to the column voltage (Vc) divided by a ratio factor (n). The factor (n) may be selected to produce the good results for a particular application. In an exemplary operation, data may be provided via the column driver (Vc) to produce an amplitude signal. If a predetermined amount (e.g., half) of the voltage of that signal is to be applied to the frame or cold cathode select line at the same time, then n is set equal to 2. The control frame or cold cathode select line driver (Vc/n) thus applies to the cold cathode select line one half of the voltage as that which is applied at the corresponding particular pixel column. The structure is driven using the same row driver (row) such that when a given row N (e.g., row 1, 2, 3, FIG. 1) is turned on, the corresponding pixel N (e.g., column N) of row 1 receives a voltage from the column driver, and the cold cathode select/emitter layer associated with pixel N receives a voltage from the cold cathode select line driver that is proportional to the voltage across pixel N. When row 2 is activated, the corresponding control frame surrounding that pixel (i.e. the cold cathode select/emitter layer associated with column N, row 2 receives a voltage that is proportional to the column driver voltage appearing column N. Thus, for each column N (e.g., where n equals 960 columns), there exists a corresponding n equal to 960 frames, where each pixel receives an appropriate voltage each time the corresponding pixel associated with the corresponding row receives an applied voltage. Storage capacitors 920 and 950 operate to hold the charge on each of the pixels and the conductive layer/emitter layer for a period of time, such as for an entire frame. When processing proceeds to the next row (e.g., row 2), the row 1 pixels are still drawing current. In this manner, capacitor 950 "remembers" the frame voltage when proceeding from one row to the next (e.g., from the first row to the second row) while capacitor 930 "remembers" the pixel voltage when going to the next row. Such processing operations continue through the entire frame.

In the case when the row lines and the cold cathode select lines are separate, the row voltage used to select the row is equal to the fully "on" voltage (Vc) of the column. The voltage Row in this case causes the pass transistor 910 to conduct. The resistance of transistor 910, the capacitor 920 and the write time of each selected row determines the voltage at the gate of transistor 930 as compared to Vc. Using a row voltage higher than the fully "on" voltage (Vc) increases the conduction of transistor 910, reducing its resistance and resulting in an increase in pixel voltage and enhanced brightness. The same advantage will also apply to the control frame voltage applied to transistors 940, 960. Thus, the selection voltage for the row is higher than the highest column voltage, thereby causing the transistors 910, 930 to conduct with a reduced resistance, thereby providing a greater voltage on the gates of transistors 940, 950.

It is further understood that other circuit configurations may also be utilized. For example, the voltage applied to the control frame structure around each pixel may also be generated by using a voltage divider circuit at each pixel which produces a voltage which is proportional to the pixel voltage While the present invention has been described with reference to the illustrative embodiments, this description is not intended to be construed in a limiting sense. Various modifications of the illustrative embodiments, as well as other embodiments of the invention, will be apparent to those skilled in the art on reference to this description. It is expressly intended that all combinations of those elements that perform substantially the same function in substantially the same way to achieve the same results are within the scope of the invention. Substitutions of elements from one described embodiment to another are also fully intended and contemplated.

What is claimed is:

1. A flat panel display comprising:

a first substrate, a passive matrix having M rows and N columns on said first substrate wherein an intersection of a row and column defines a pixel location, said pixel location including a conductive pad and a phosphor layer;

a second substrate joined to said first substrate about a periphery to form a display housing having an internal hollow, an ionizable gas contained in said hollow maintained at a low pressure;

a plurality of cold cathode emitters located on said first substrate, wherein at least one cold cathode emitter is positioned between adjacent pixels and adjacent to a corresponding pixel and when energized emits electrons to activate a selected pixel, and means coupled to said passive matrix to select a pixel; and means to select one of said cold cathodes to generate electrons that cause said selected pixel to emit light; and means to ionize said gas, wherein interaction of said electrons generated by said selected one of said cold cathodes with said gas causes generation of ions drawn to said selected one of said cold cathodes resulting in an increase of a current produced by the generated electrons striking a corresponding phosphor layer.

2. The flat panel display according to claim 1, wherein said first and second substrates are glass.

3. The flat panel display according to claim 2, wherein said glass is soda lime glass.

4. The flat panel display according to claim 1, wherein each pixel is coated with a colored phosphor.

5. The flat panel display according to claim 1, wherein said ionizable gas is selected as one of a noble gas and a combination of noble gases.

6. The flat panel display according to claim 5, wherein said noble gas includes argon.

7. The flat panel display according to claim 1, wherein said second substrate has a portion of the surface within said hollow coated with a transparent metal layer.

8. The flat panel display according to claim 7, wherein said means for ionizing said gas comprises:

a voltage source connected to said metal layer to apply a voltage to said metal layer sufficient to ionize said gas during an interval associated with said selected pixel.

9. The flat panel display according to claim 1, further including a conductive frame on said first substrate forming a plurality of frame elements for each pixel.

10. The flat panel display according to claim 1, wherein said cold cathodes are selected from a group consisting of: carbon nanotubes, edge emitters, and tips.

11. A flat panel display according to claim 1, wherein said ionization of gas is caused by the Townsend Discharge.

12. The flat panel display according to claim 9, wherein said cold cathode emitters are located on said conductive frame.

13. The flat panel display according to claim 1, wherein said gas is a gas mixture including a noble gas.

14. A display comprising:

a first substrate having a conductive frame on said first substrate, a plurality of addressable pixels positioned on said first substrate in predetermined locations with respect to said frame, a plurality of cold cathode emitters positioned on said frame, said cold cathode emitters positioned between adjacent pixels and adjacent to a corresponding pixel;

a second substrate joined to said first substrate about a periphery to form between said first substrate and said second substrate an envelope having an internal hollow;

an ionizable gas contained in said hollow maintained at a low pressure, and means for ionizing said gas when a pixel is addressed:

means for actuating a cold cathode emitters corresponding to said addressed pixel to emit electrons to cause said addressed pixel to emit light, wherein interaction of said emitted electrons with said gas causes generation of ions, which are drawn to said cold cathode corresponding to said addressed pixel, which results in an increase of a current to the addressed pixel.

15. The flat panel display according to claim 14, further including an X-Y matrix positioned on said first substrate and having an addressable pixel at each X-Y intersection.

16. The flat panel display according to claim 14, wherein each pixel has a phosphor associated therewith for emitting light of a specific color when said pixel is energized.

* * * * *